US009062953B2

(12) United States Patent
Leppanen

(10) Patent No.: US 9,062,953 B2
(45) Date of Patent: Jun. 23, 2015

(54) ROCK BREAKING PRODUCT

(75) Inventor: Jarmo Uolevi Leppanen, East Rand (ZA)

(73) Assignee: SANDVIK MINING AND CONSTRUCTION RSA (PTY) LTD, East Rand (ZA)

( * ) Notice: Subject to any disclaimer, the term of this patent is extended or adjusted under 35 U.S.C. 154(b) by 0 days.

(21) Appl. No.: 13/639,553

(22) PCT Filed: Apr. 6, 2011

(86) PCT No.: PCT/ZA2011/000018

§ 371 (c)(1),
(2), (4) Date: Dec. 5, 2012

(87) PCT Pub. No.: WO2011/127491

PCT Pub. Date: Oct. 13, 2011

(65) Prior Publication Data

US 2013/0199393 A1 Aug. 8, 2013

(30) Foreign Application Priority Data

Apr. 6, 2010 (ZA) ..... 2010/02370

(51) Int. Cl.

| | |
|---|---|
| ***F42D 1/20*** | (2006.01) |
| ***F42D 1/22*** | (2006.01) |
| ***F42D 1/04*** | (2006.01) |
| ***F42D 3/04*** | (2006.01) |
| ***F42D 1/08*** | (2006.01) |

(Continued)

(52) U.S. Cl.

CPC . *F42D 3/04* (2013.01); *E21C 37/10* (2013.01); *F42B 3/087* (2013.01); *E21C 37/12* (2013.01); *F42D 1/20* (2013.01); *F42D 1/08* (2013.01); *F42D 1/22* (2013.01); *F42D 1/04* (2013.01)

(58) Field of Classification Search

CPC ..... F42D 1/08; F42D 1/20; F42D 3/04; F42D 1/04; F42B 3/087; E21C 37/10; E21C 37/12

USPC ..... 102/301, 304, 325, 328, 329, 330, 333, 102/313, 324; 299/13

See application file for complete search history.

(56) References Cited

U.S. PATENT DOCUMENTS 2,083,975 A * 6/1937 Armstrong ..... 102/325
2,207,205 A * 7/1940 Sandoe ..... 102/325

(Continued)

FOREIGN PATENT DOCUMENTS

CN 2222340 Y 3/1996
CN 1176377 A 3/1998

(Continued)

OTHER PUBLICATIONS

International Search Report for PCT/ZA2011/000018, dated Sep. 16, 2011.

(Continued)

*Primary Examiner* — James S Bergin
(74) *Attorney, Agent, or Firm* — Morgan, Lewis & Bockius LLP

(57) ABSTRACT

A rock breaking product which includes a sealed, elongate, flexible tube, a cartridge, with an energetic material, inside the tube and a valve arrangement for allowing the tube to be filled and expanded with water whereby the cartridge is placed in a mode in which the energetic material can be ignited.

10 Claims, 5 Drawing Sheets

(51) Int. Cl.

| | |
|---|---|
| ***E21C 37/10*** | (2006.01) |
| ***E21C 37/12*** | (2006.01) |
| ***F42B 3/087*** | (2006.01) |

(56) References Cited

U.S. PATENT DOCUMENTS

| | | | | |
|---|---|---|---|---|
| 2,247,169 | A | 6/1941 | Gilbertson | |
| 3,134,437 | A * | 5/1964 | Karpovich | 166/299 |
| 3,645,205 | A * | 2/1972 | Dowling | 102/318 |
| 3,691,954 | A * | 9/1972 | Kern | 102/318 |
| 3,696,703 | A | 10/1972 | Fox | |
| 3,960,082 | A * | 6/1976 | Sloevsky et al. | 102/325 |
| 4,036,100 | A | 7/1977 | Hurley | |
| 4,040,330 | A | 8/1977 | Matzen | |
| 4,141,592 | A * | 2/1979 | Lavon | 299/16 |
| 4,492,165 | A * | 1/1985 | Marz | 102/313 |
| 4,522,125 | A | 6/1985 | Marz | |
| 4,572,075 | A * | 2/1986 | Day et al. | 102/313 |
| 4,813,358 | A * | 3/1989 | Roberts | 102/313 |
| 5,192,819 | A * | 3/1993 | Baumgartner | 86/20.15 |
| 5,198,613 | A * | 3/1993 | Jenkins, Jr. | 102/313 |
| 5,233,926 | A | 8/1993 | Carmichael et al. | |
| 5,798,477 | A * | 8/1998 | Givens et al. | 102/319 |
| 6,318,272 | B1 * | 11/2001 | Mey | 102/302 |
| 6,435,096 | B1 | 8/2002 | Watson | |
| 6,453,818 | B1 * | 9/2002 | Brent | 102/313 |
| 6,886,466 | B2 * | 5/2005 | Senules | 102/313 |
| 7,267,182 | B2 | 9/2007 | Saha | |
| 7,367,631 | B2 * | 5/2008 | Van Dyk | 299/13 |
| 8,118,112 | B2 | 2/2012 | Juvonen | |
| 8,381,653 | B2 * | 2/2013 | Zimmermann | 102/313 |
| 2005/0134103 | A1 | 6/2005 | Dyk | |
| 2011/0266053 | A1 | 11/2011 | Leppanen et al. | |

FOREIGN PATENT DOCUMENTS

| | | | |
|---|---|---|---|
| CN | 1198812 | A | 11/1998 |
| CN | 101403223 | A | 4/2009 |
| EP | 1 436 487 | | 7/2004 |
| EP | 1 632 636 | A1 | 3/2006 |
| EP | 2 324 199 | A1 | 9/2008 |
| GB | 29796 | | 0/1911 |
| KR | 20080007545 | A | 1/2008 |
| WO | 97/21068 | | 6/1997 |
| WO | WO 2006/099637 | A2 | 11/2006 |
| WO | WO 2010/029220 | A1 | 3/2010 |
| WO | WO 2010/088705 | A1 | 8/2010 |
| ZA | 980170 | | 10/1998 |

OTHER PUBLICATIONS

SIPO: First Office Action for Chinese Patent Application No. CN 201180017664.3—Issued on Jan. 15, 2014—Including English Translation.

Chilean Office Action for Chilean Patent Application No. 0336-10, dated Aug. 13, 2012.

Australian Patent Examination Report for Australian Patent Application No. 2011237288, dated Jul. 12, 2013.

* cited by examiner

ROCK BREAKING PRODUCT

RELATED APPLICATIONS

The present application is a U.S. National Phase Application of International Application No. PCT/ZA2011/000018 (filed 6 Apr. 2011) which claims priority to South African Application No. 2010/02370 (filed 6 Apr. 2010).

BACKGROUND OF THE INVENTION

This invention relates to a product for breaking rock using a propellant.

During mining and other excavation processes use is typically made of an explosive to break rock. Rocks which are released during blasting are of different sizes and shapes. Some rocks are too large to be handled by available equipment. In other instances rocks which are channelled through an ore pass or box hole can become interlocked in such a way that passage through the ore pass is blocked.

Different techniques exist for breaking rocks which are in different positions, for example on the ground, or in or above an ore pass or a box hole. Reference is made in this respect to the specifications of U.S. Pat. Nos. 5,233,926 and 2,247,169 which categorize certain situations and which propose techniques for addressing attendant problems.

When an explosive material is used to fracture a problematic rock the energy which is released, during the resulting blast, can be at such a high level that surrounding supporting structure is damaged. This is unacceptable. On the other hand it can be dangerous to place a charge, whether explosive- or propellant-based, in a rock which is at an overhead position.

In some situations a plurality of holes must be drilled into one or more rocks which must be fragmented or displaced. For safety reasons it is generally not advisable to drill a hole, charge the hole and then drill a successive hole. It is quite possible under these conditions that the drill can penetrate an explosive which has previously been positioned. The drill might cause the explosive to be ignited. The consequences of unwanted ignition can be severe.

An object of the invention is to provide a rock breaking product which facilitates a secondary rock breaking process and which offers a high degree of safety.

SUMMARY OF THE INVENTION

The invention provides a rock breaking product a rock breaking product which includes a sealed, elongate, flexible tube, a cartridge, with an energetic material, inside the tube and a valve arrangement for allowing the tube to be filled and expanded with a liquid whereby the cartridge is placed in a mode in which the energetic material can be ignited.

The tube may have an internal bore and opposed first and second ends which are sealed. The cartridge is preferably located inside the bore.

The valve arrangement may include an inlet connection for introducing a liquid into the bore thereby to pressurise the bore and so expand the tube at least in a radial sense, and an outlet connection through which air can escape from the bore.

The rock breaking cartridge may include a device for igniting the energetic material.

The inlet connection may include a one-way filler valve to allow the liquid, e.g. water, to pass into the bore and not escape from the bore.

The outlet connection may include an air-bleed valve.

At least one stiffening component may be positioned inside the bore to stiffen the tube, at least to some degree, in an axial direction.

The inlet connection may be near or at the first end of the tube and the outlet connection may be near or at the second end of the tube.

The tube may have a wall which is progressively weakened from the second end towards the first end. Thus when the tube is internally pressurised there is a tendency for the tube to expand radially at the first end before radial expansion of the tube at any other position takes place.

The product may include a retention device for retaining the tube within a borehole formed in a rock which is to be broken.

The energetic material may be an explosive or propellant of any suitable type. To enhance the safety of the rock breaking product the cartridge is preferably of the kind described in the specification of International Patent Application No. PCT/ZA2010/000004 the content of which is hereby incorporated into this specification. This type of cartridge includes a first, fairly large chamber which contains a propellant and a second, substantially smaller chamber which contains a small charge. The construction of the cartridge is such that inadvertent initiation of the charge does not result in the ignition of the propellant. Such ignition can only take place if the cartridge is immersed in an incompressible liquid e.g. water, mud etc.

BRIEF DESCRIPTION OF THE DRAWINGS

The invention is further described by way of examples with reference to the accompanying drawings in which.

DESCRIPTION OF PREFERRED EMBODIMENTS

Figure 1:
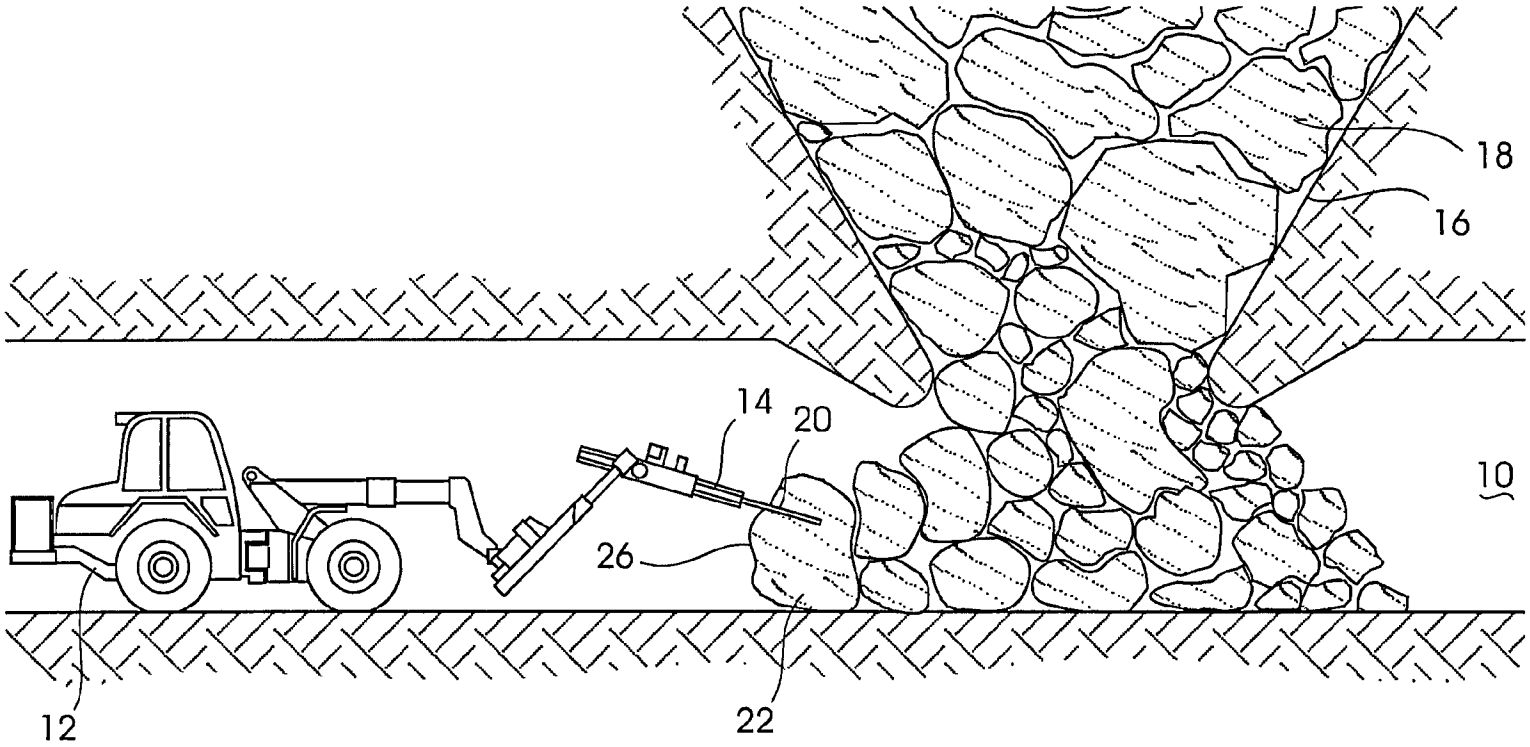
FIG. 1 depicts a situation, in this case underground, in which one or more relatively large rocks are to be broken in a secondary blasting process.
Figure 2:
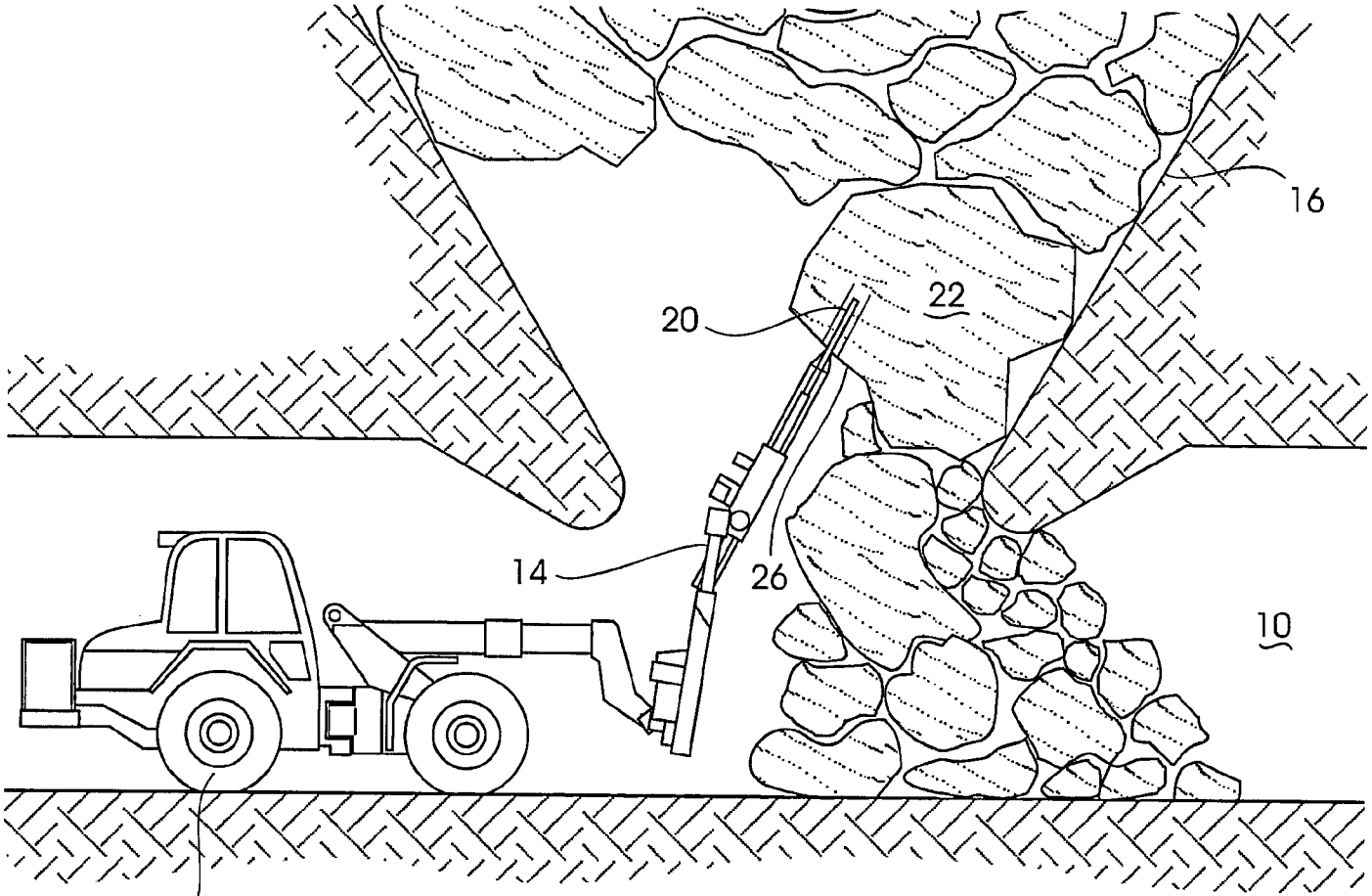
FIG. 2 shows a situation similar to that illustrated in FIG. 1, but where a rock which is to be broken is at an overhead position.

FIGS. 1 and 2 show an underground excavation 10 in which a mining machine 12 is movable. The machine carries a rock drill 14 of any appropriate kind which can drill a hole in a rock and which, preferably, can thereafter place a rock breaking product, according to the invention, in the hole.

FIG. 2 shows a particular application for the product i.e. when a rock which is to be broken is overhead. The use of the product is however not limited in this way, for, as is shown in FIG. 1, the rock which is to be broken may be more or less at ground level. For example, if the rock (at ground level) has one or more cracks and water leaks out of a borehole in the rock at a rate which is higher than the rate at which water can be placed into the borehole then it is not normally possible to make use of a rock breaking process which employs a cartridge to impart a shockwave to water in the hole. In this type of situation the rock breaking product of the invention can be used with a substantial degree of effectiveness.

An ore passage 16 is constructed so that rock 18 can pass, under gravity action, from an upper level (not shown) through the passage, to the excavation. The rocks at the upper level can vary substantially in size.

As shown in FIGS. 1 and 2 the rock drill 14 is used to drill a borehole 20 in a rock 22 which is so large that it cannot be handled by machines or other techniques which are available in the excavation. The borehole 20 extends into the rock 22 from a face 26. The borehole has a mouth 28 and a blind end or bottom 30—see FIG. 3.

Figure 3:
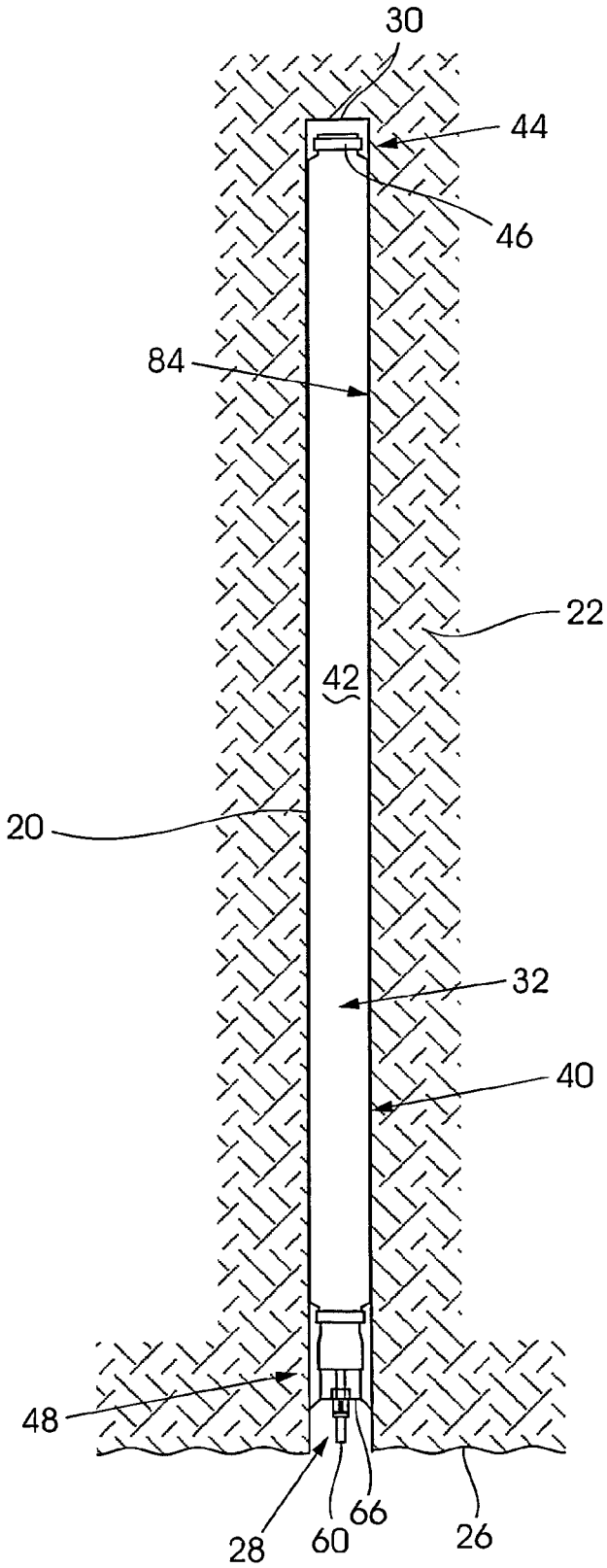
FIG. 3 is a schematic representation of a borehole, in a rock, which contains a rock breaking product according to the invention.
Figure 4:
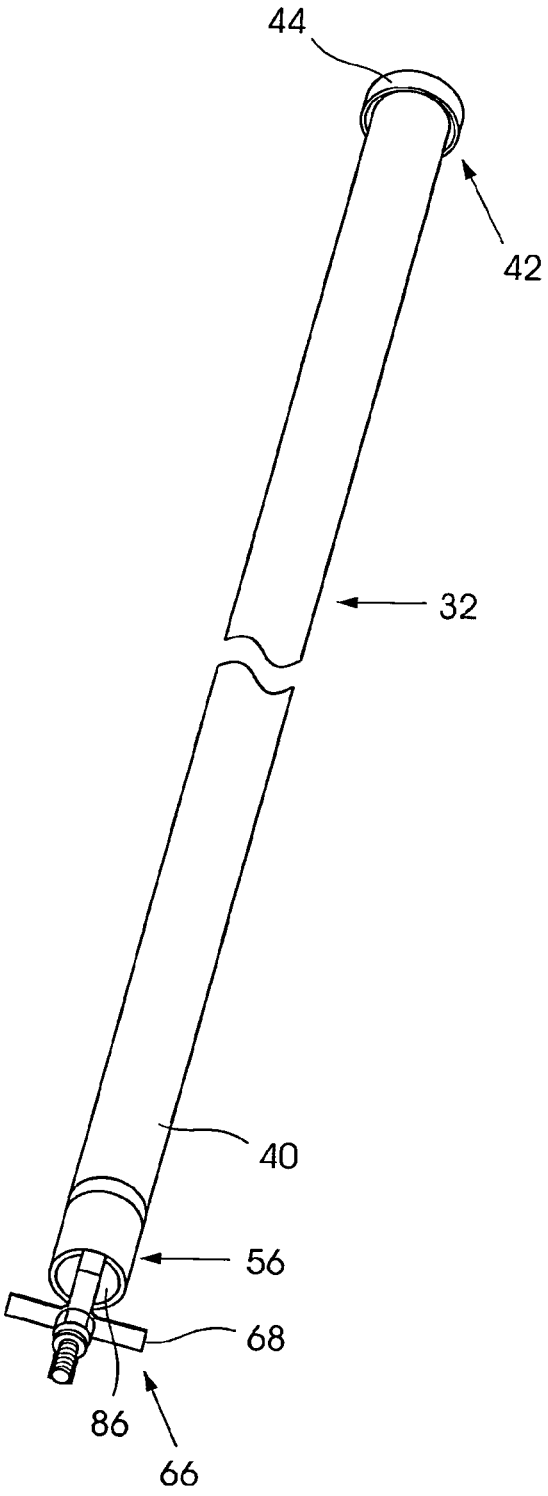
FIG. 4 is a perspective view of the rock breaking product in an inoperative mode.
Figure 5:
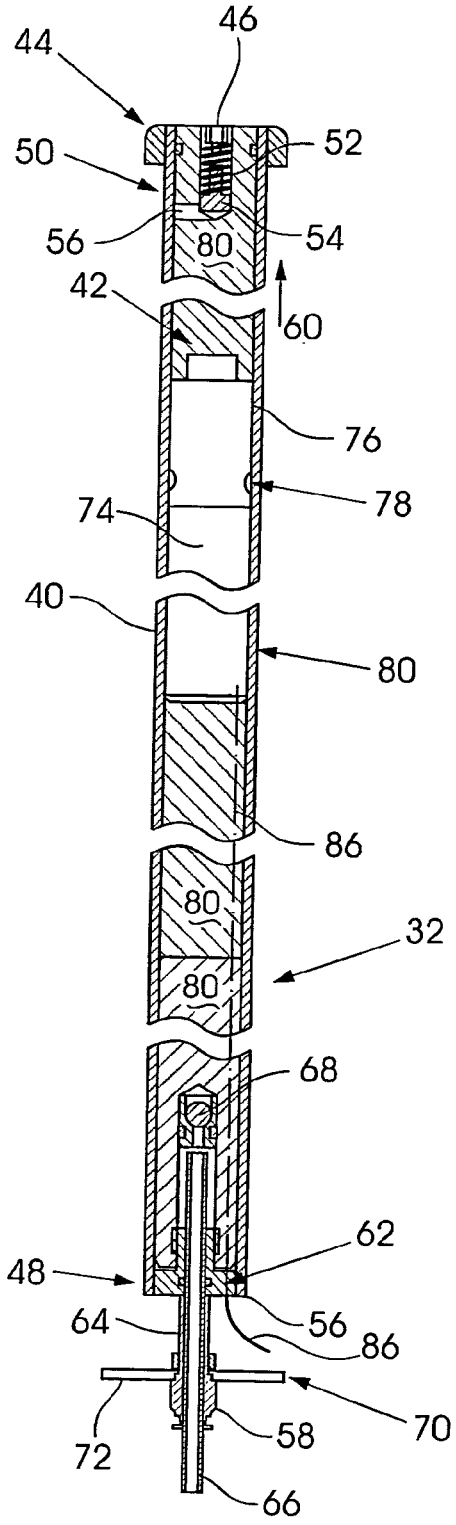
FIG. 5 is a side view in cross-section of the rock breaking product.

A rock breaking product 32, according to the invention, is positioned inside the hole. FIG. 3 shows the product 32 in an operative mode while FIGS. 4 and 5 show the product in an inoperative mode in perspective, and from one side in cross-section, respectively.

The product 32 includes an elongate flexible tube 40 which is made from an appropriate material such as natural rubber. The tube has a bore 42, a sealed first end 44 which is surrounded by an external collar 46 and an opposed second end 48.

An air bleed valve 50 is positioned in the bore 42 near the first end 44. The valve has a housing with a cavity 52 which houses a valve member 54. A passage 56 extends in the housing laterally from the cavity. If the bore 42 is pressurised then the valve member is displaced in an axial direction 60 and air can be vented from the bore through the passage 56. However once the bore is filled with water and if the tube 40 is immersed in water then the valve member is movable to close and seal the passage. Water cannot then escape from the bore.

A plug 62 is used to seal the second end 48 of the tube. A connector 64 extends from the plug and is coupled to a flexible conduit 66 which extends through the plug to a one-way filler valve 68 which is designed to allow the flow of a liquid into the bore 42. A retention spring 70 which is fixed to the connector has a number of radial arms 72. Each arm has a length in a radial sense which is slightly greater than the radius of the borehole 20.

A cartridge 74 is positioned in the bore 42 near the first end 44. The cartridge may be of any suitable kind but preferably is of the type described in the specification of International Patent Application No. PCT/ZA2010/000004 the content of which is hereby incorporated into this specification. The construction and characteristics of the cartridge are not fully described herein but, to facilitate an understanding of the present invention, it is pointed out that the cartridge includes a first, relative large chamber which contains an energetic material in the form of a propellant and a second, substantially smaller chamber which contains a small charge. The cartridge has a housing 76 and a wall of the housing is formed with one or more apertures 78. If the cartridge is immersed in an incompressible liquid then ignition of the charge, in the small chamber, causes firing of the propellant in the large chamber. On the other hand if the charge is ignited while the cartridge is in air it is not possible for sufficient force to be transmitted by the charge to initiate the propellant. A propellant substance, by its nature, requires confinement so that its burn rate is enhanced and to evolve highly energetic gasses. Without confinement the propellant would burn creating a high temperature gas that would melt the cartridge housing and the flexible tube 40. The cartridge thus exhibits inherently safe characteristics in that the cartridge can only be used effectively if it is confined in an incompressible liquid such as water, mud or the like.

The tube 40 has a wall 80 which weakens progressively from the second end 48 to the first end 44. For example the thickness of the wall can be decreased from a maximum thickness at the second end to a minimum thickness at the first end, in a linear fashion. This manner of weakening the wall of the tube is exemplary only and is non-limiting.

The tube 40 is made from a flexible material such as rubber. This means that, inter alia, in an axial direction the tube has no significant stiffness i.e. the tube bends easily about its longitudinal axis. To address this feature a number of inserts 82 are positioned in the bore 42. Each insert, which may be a tubular section, acts as a longitudinally extending stiffening component which inhibits the tube from flexing to a significant extent about a region in which the insert is located. In addition, if a number of inserts are positioned end to end, abutting one another, it is possible to transmit force applied to the second end 48 in an axial sense towards the first end 44.

After the borehole 20 has been drilled the product 32 is pushed into the borehole. This can be done manually or by using the drilling machine 12 which is suitably adapted for the purpose. The tube 40 is urged into the hole to a predetermined extent, towards to the bottom of the drilled hole, and so that the spring 70 enters the borehole. The arms 72 of the spring are deflected rearwardly. The deflected arms do not impede the insertion of the product into the borehole 20. However, as the arms have a natural tendency to expand in a radial sense, they engage frictionally and physically with a wall 84 of the borehole and thereby help to retain the product inside the borehole.

Preferably the product 32 is placed in the borehole immediately after the borehole is drilled. The borehole 20 can be one of a plurality of similar boreholes which are drilled in succession into the rock 22 or into any other rock or rocks. The ongoing process of drilling and placing the rock breaking products can be continued in relative safety for if the rock drill inadvertently penetrates a cartridge 74 and causes firing of the initiating charge it is not possible, for the reasons which have described, for the main propellant charge to be ignited. Drilling is done with air/water mist flushing at all times and the air blows all water out of the hole. If the propellant charge is inadvertently initiated by the drilling process gasses which are evolved by the burning propellant can escape to atmosphere. The cartridge, at this stage, is not confined by a liquid or other stemming material and, as the tube 40 has a diameter which is smaller than the diameter of the borehole 20, the evolving gasses can escape to the atmosphere through a gap between an outer surface of the tube and a surface of the wall 84.

The conduit 66 extends from the product 32 after it has been placed in a borehole.

Once the drilling and product placement process has been completed the various conduits 66 are drawn together and pressurised water is introduced into each tube through the corresponding conduit. In each case water flows through the one-way filler valve 68 and the bore 42 is gradually filled with water. Air inside the bore 42 is displaced through the bleed valve 50 and vented to atmosphere. Once the tube is full of water the bleed valve closes to prevent water from escaping from the tube which is then internally pressurised by the water. The weaker portion of the tube near the first end 44 is expanded in a radial sense and is thereby brought into contact with an opposing surface of the wall 84. Thereafter the tube progressively expands from the first end towards the second end and all air in the borehole is displaced to atmosphere.

Each cartridge has a respective ignition lead 86 (FIGS. 4 and 5) which extends to outside the borehole. After the tubes of the various products have been fully inflated the charges in the cartridges are fired, when appropriate, by application of a suitable electrical signal to the leads 86. This, in turn, causes initiation of the propellant in each cartridge and breaking of the rock 22 ensues, generally in the manner described in the specification of International Patent Application No. PCT/ZA2010/000004.

Each ignition lead 86 may be located inside, and extend from, the corresponding flexible conduit 66, to provide a more compact design.

The preceding description refers to the use of water as the pressurising medium. This is exemplary only and non-limiting for denser liquids e.g. mud or bentonite can be used to pressurise the tube internally. This enhances tamping efficiency.

Figure 6:
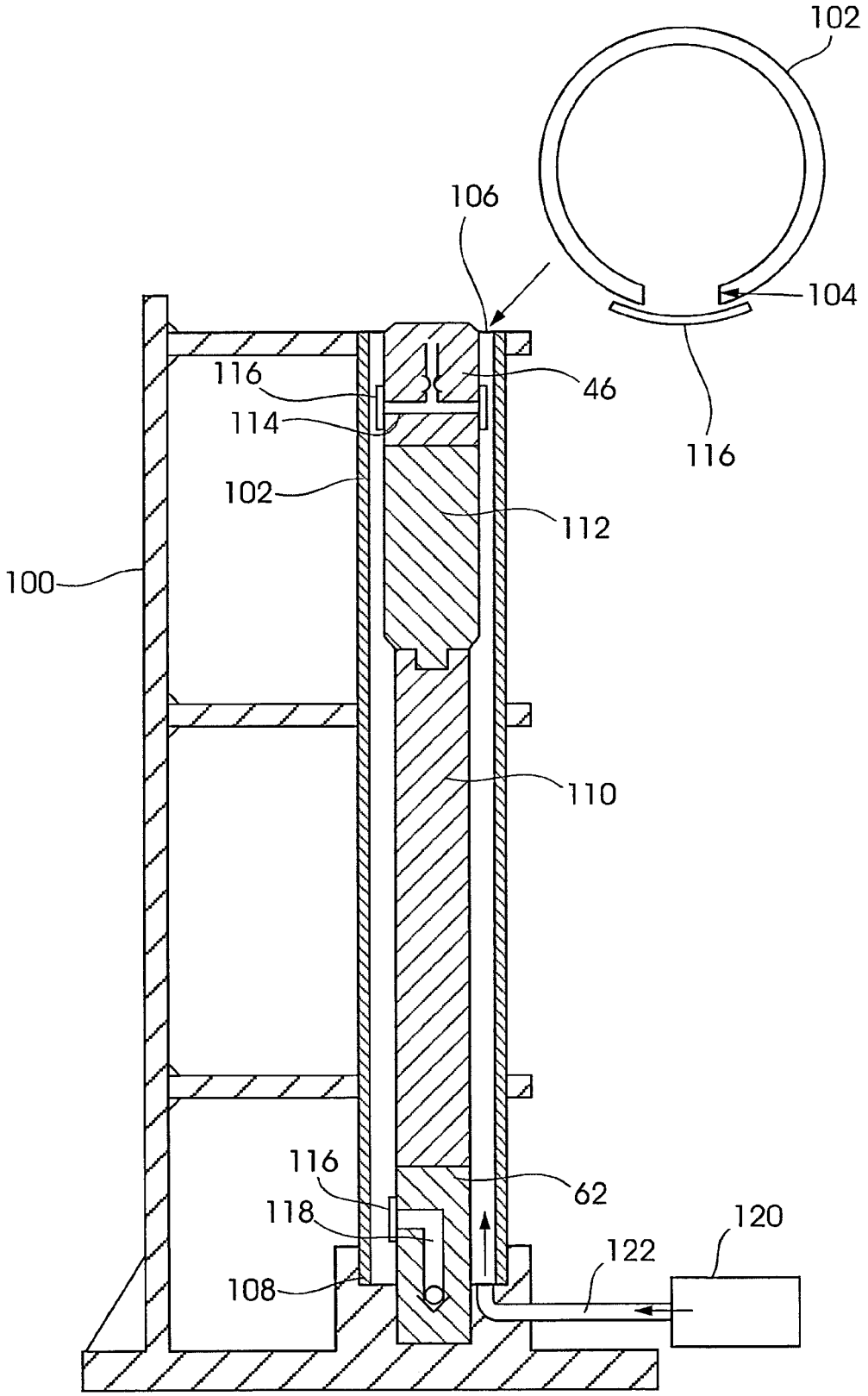
FIG. 6 illustrates a technique which can be used in assembling the rock breaking product according to a modified form of the invention.

In an alternative approach, depicted in FIG. 6, use is not made of a preformed tube but of a custom-made tube.

A vertically extending support 100 maintains a tube 102, which is made from a fairly rigid plastics material, in a vertical orientation. The tube has a slit 104 which extends longitudinally from an upper end 106 of the tube to a lower end 108. This allows the tube to be opened up, to some extent, against its natural resilience.

Components which are similar to those which have been described are used. An upper end of a solid rod 110 of plastic or a similar material is attached to an abutting end of a dummy cartridge 112 using an adhesive tape. The dummy cartridge has the same shape and size as a cartridge 74 which is fully functional. An air bleed valve 50 of the kind described hereinbefore is positioned at an upper end of the dummy cartridge 112. Outlet apertures 114 from the air-bleed valve are sealed by means of a length of a frangible adhesive tape 116. A one-way filler valve 68 of the kind described hereinbefore is engaged with a lower end of the rod 110 and an outlet 118 from the filler valve is sealed by means of a length of the adhesive tape 116.

The components are then externally coated with an appropriate release agent and an inner surface of the tube 102 is also coated with the release agent. The components 110, 112, 50 and 68, which have been linked together in the manner described, are then placed in the tube 102 so that these components extend in an axial direction of the tube. The slit 104 in the tube is taped over so that, effectively, the interior of the tube is sealed. A fluent mixture of a settable silicone material 120 of a kind known in the art is then pumped through a tube 122 into a lower end of the plastic tube thereby to encapsulate the components in the tube 102. The silicone material rises from the lower end 108 to the upper end 106 of the tube and, in the process, all air is expelled from the tube. The silicone, in fluent form, is not at any meaningful pressure and does not interfere with the sealing tape 116, over the air-bleed valve, the one-way filler valve and the slit as it enters the plastic tube. The silicone is then allowed to set.

Subsequently the tube 102 and its contents are detached from the support 100. The tape over the longitudinal slit 104 is removed and the tube is diametrically expanded so that its contents can be removed. These contents comprise the components 110, 112, 50 and 68 which are externally encased in a tube-like shell formed from the set silicone.

The silicone material is flexible and can be deformed to allow the dummy cartridge 112 to be removed and so reveal a cavity. The cartridge does not adhere to the silicone because of the prior use of the release agent. A genuine cartridge 74 of the kind referred to herein is then inserted into the cavity in the silicone shell to abut the rod 110. Upper and lower ends of the silicone shell are sealed by encircling these ends with ring clamps which are tightened onto outer surfaces of the filler valve 68 and of the genuine cartridge 74 respectively.

When the genuine cartridge is placed into the cavity, formed by the removed dummy cartridge, a small wire is located on an outer side of the cartridge so that an air passage is formed between opposing surfaces of the cartridge and of the silicone shell. Air can thus escape from a cavity, inside the cartridge, as described in the specification of International Patent Application No. PCT/ZA2010/000004.

The use of the silicone moulding composition thus allows the formation of a flexible tube around the components of the rock breaking product. The moulded assembly can be used substantially in the way which has been described hereinbefore. Water introduced through the filler valve can flow between an inner surface of the silicone shell and opposing outer surfaces of the components inside the shell. As noted, the silicone does not adhere to these components because of the prior use of the release agent. The water expands the silicone into tight engagement with a wall of a borehole in which the assembly is located. The water pressure is increased to rupture the seals formed by the adhesive tape 116. As the volume of the water in the silicone shell increases air escapes from the silicone shell due to the action of the air-bleed valve. Water can also enter into the air cavity inside the genuine cartridge so that, as has been described hereinbefore, effective ignition can take place when necessary.

The use of the moulding composition allows the blasting product to be tailor-made for the particular application, an aspect which facilitates handling and installation.

The product of the invention has a number of significant benefits. It allows for secondary rock breaking to take place in a safe and effective manner. A number of boreholes can be drilled, one after the other, into one or more rocks and after each borehole is drilled a respective rock breaking product is placed in the borehole. This avoids the situation in which a cartridge is placed in each borehole only after a plurality of boreholes have been drilled. The cartridge 74 is inherently safe for it only exhibits a rock breaking function when it is immersed in an incompressible liquid such as water, mud, betonite or the like.

The invention claimed is:

1. A rock breaking product including:

a sealed, elongate, flexible tube, a cartridge, with an energetic material, inside the tube, a valve arrangement for allowing the tube to be filled and expanded with a liquid, and a device for igniting the energetic material when the cartridge is immersed in the liquid, wherein the tube has an internal bore and opposed first and second ends which are sealed, and the cartridge is located inside the bore, and wherein the valve arrangement includes an inlet connection for introducing a liquid into the bore thereby to pressurise the bore and so expand the tube at least in a radial sense and an outlet connection through which air can escape from the bore.

2. A rock breaking product according to claim 1 wherein the inlet connection includes a one-way filler valve to allow the liquid to pass into the bore and not escape from the bore.

3. A rock breaking product according to claim 1 wherein the outlet connection includes an air-bleed valve.

4. A rock breaking product according to claim 1 wherein the inlet connection is at the first end of the tube and the outlet connection is at the second end of the tube.

5. A rock breaking product according to claim 1 wherein the tube has a wall which is expansible radially at the first end, when the bore is pressurised, before radial expansion of the tube at any other position takes place.

6. A rock breaking product according to claim 1 which includes a stiffening component inside the bore to stiffen the tube, at least to some degree, in an axial direction.

7. A rock breaking product according to claim 1 wherein the liquid is an incompressible liquid.

8. A rock breaking product according to claim 7 wherein the device for igniting the energetic material only ignites the energetic material when the cartridge is immersed in the incompressible liquid.

9. A rock breaking product according to claim 1 which includes a retention device for retaining the tube within a borehole formed in a rock which is to be broken.

10. A rock breaking product according to claim 1 wherein the tube is formed in a moulding process to encapsulate the cartridge, and the valve arrangement.

* * * * *